US005839843A

United States Patent [19]

Bedol

[11] Patent Number: 5,839,843

[45] **Date of Patent: *Nov. 24, 1998**

[54] COMBINATION BOOK AND HOLEPUNCH ASSEMBLY

[76] Inventor: Mark A. Bedol, 3423 Yankton Ave., Claremont, Calif. 91711

[ * ] Notice: The term of this patent shall not extend beyond the expiration date of Pat. No. 5,553,958.

[21] Appl. No.: 833,292

[22] Filed: Apr. 4, 1997

[51] Int. Cl.[6] ..... B42F 3/00

[52] U.S. Cl. ..... 402/4

[58] Field of Search ..... 402/1, 4, 50 R; 281/51, 28, 37

[56] References Cited

U.S. PATENT DOCUMENTS

| | | | |
|---|---|---|---|
| 5,058,736 | 10/1991 | Bedol | 206/214 |
| 5,209,592 | 5/1993 | Bedol | 402/1 |
| 5,409,319 | 4/1995 | Bedol | 402/1 |
| 5,553,958 | 9/1996 | Bedol | 402/1 |

OTHER PUBLICATIONS

McGill, Inc., 2–Piece, 3–Hole Binder Punch (2 Copies of Photographs).

McGill, Inc., Plastic Base/Metal Hinge, 3–Hole Punch (2 Copies of Photographs).

Day Runner, Inc. Pro$^{TM}$ Holepunch (2 Copies of Photographs).

Day Runner, Inc. No. 043–112, 6–Hole Holepunch (2 Copies of Photographs).

*Primary Examiner*—Willmon Fridie, Jr.

[57] ABSTRACT

The combination book and holepunch assembly includes a book and at least one holepunch assembly securely attached to a flat portion of the book. The holepunch assembly includes a first rigid plate and a second rigid plate. The first rigid plate is securely connected to the flat portion and has an opening formed therethrough. The second rigid plate is rotatably connected to the first rigid plate. The second rigid plate includes a punching element. The punching element is sized and spaced to align with the opening in the first plate when the second plate is rotated away from a stowed position so as to provide a holepunching capability when paper is inserted between the first plate and the second plate.

10 Claims, 2 Drawing Sheets

COMBINATION BOOK AND HOLEPUNCH ASSEMBLY

BACKGROUND OF THE INVENTION

1. Field of the Invention

The present invention relates to books and their peripherals and more particularly to a book with an integral holepunch mechanism.

2. Description of the Related Art

Users of notebooks, including businessmen and students, often desire to have various articles such as pencils and pens at their easy disposal when they use their notebook and to be secure from being lost when they carry their notebooks from one location to another.

In partial solution to this problem, present applicant Mark A. Bedol, invented a "Notebook Organizer Including Slidable Element", U.S. Pat. No. 5,050,736. The '736 patent discloses an organizer comprising a base with holes for engagement with the rings of a ringed notebook. The base includes a plurality of partitions which divide the base into a plurality of compartments. The patent also discloses an electronic calculator having a longitudinal extension thereon being slidably engageable with, and supported between, opposing partition surfaces.

Present applicant, Mark A. Bedol, is the inventor of "Combination Book and Holepunch Assembly," U.S. Pat. No. 5,553,958, which discloses the use of a book having a flat portion thereon and a holepunch assembly securely attached to the flat portion. The holepunch assembly comprises a housing comprising a first rigid substantially flat plate securely connected to the flat portion. The housing has a set of a plurality of spaced holes formed therethrough a side thereof. The housing further includes an opening in a central portion thereof. A plurality of spaced hinges are located on a side edge of the central portion defined by the opening. A second rigid plate is included having a first hingedly connected via the spaced hinges to the first rigid plate. The second plate has a shape complementary to the shape of the central opening so that when the second rigid plate is in a stowed position it may be supported with the central opening. The second plate includes spaced projections formed on an upper surface thereof. The projections are so sized and spaced to align with the second set of spaced holes in the first plate when the second plate is rotated away from the stowed position so as to provide a hole punching capability when paper is inserted between the first plate and the second plate.

Present applicant Mark A. Bedol, has also invented "Notebook Insert With Calculator and Holepunch", U.S. Pat. No. 5,209,592, which discloses a notebook insert comprising a housing, an electronic calculator attached to the housing and a holepunch assembly also attached to the housing. The housing has a periphery with multiple holes therethrough which are spaced to be adapted for engagement with the rings of a ringed notebook.

McGill, Inc. of Maringo, Ill., discloses a three-hole binder punch which is insertable into the rings of a ringed binder. This binder punch involves two pieces. A first piece inserts through the rings of the binder and a second piece, the holepunch mechanism, snaps into place on the first piece.

McGill also manufactures another three-hole paper punch under the trademark Trident. The Trident holepunch includes a plastic base with a metal hinge mechanism attached along the top surface thereof.

Day Runner, Inc., Fullerton, Calif. distributes a seven-hole punch under the trademark Pro. The Pro holepunch comprises a first plate hinge connected to a second plate, the two cooperating to form a holepunch mechanism which inserts into a ringed binder. The Pro holepunch is in a stowed position when the two plates are in cooperative engagement (i.e., the holepunch is closed). The Pro holepunch does not lie flat within the open position.

Day Runner, Inc. distributes another holepunch, a six-hole punch, Part No. 043-112. The six-hole punch cannot be used to punch paper unless it is removed from the rings of the binder.

Present applicant has also invented another device which is an improved notebook insert with holepunch. This is disclosed in U.S. Pat. No. 5,409,319. The invention is a notebook insert with a housing having a first rigid substantially flat plate having a first set of a number of spaced holes formed therethrough a first side thereof, the first set of holes being adapted for engagement with the rings of a ringed notebook. The housing further has a second set of a number of spaced holes formed therethrough a second side thereof. The housing further includes an opening in a central portion thereof. A number of spaced hinges are located on a side edge of the central portion defined by the opening. A second rigid plate has a first side hingedly connected via the spaced hinges to the first rigid plate. The second plate has a shape substantially matching the shape of the central opening so when the second rigid plate is in a stowed position it may be supported within the central opening. The second plate includes spaced projections formed on an upper surface thereof. The projections are so sized and spaced to align with the second set of spaced holes in the first plate when the second plate is rotated away from the stowed position so as to provide a holepunching capability when paper is inserted between the first plate and the second plate. Thus, the holepunch capability may be utilized without a need for removing the notebook insert from a binder it may be attached to.

OBJECTS AND SUMMARY OF THE INVENTION

It is a principal object of the present invention to incorporate holepunching capability with a book.

Another object is to maximize the usable space in a ringed binder.

Yet another object is to provide a holepunching mechanism which is not limited to applications with ringed binders.

In a broad aspect, the combination book and holepunch assembly includes a book and at least one holepunch assembly securely attached to a flat portion of the book. The holepunch assembly comprises a first rigid plate and a second rigid plate. The first rigid plate is securely connected to the flat portion and has an opening formed therethrough. The second rigid plate is rotatably connected to the first rigid plate. The second rigid plate includes a punching element. The punching element is sized and spaced to align with the opening in the first plate when the second plate is rotated away from a first position to a second position so as to provide a holepunching capability when paper is inserted between the first plate and the second plate.

Preferably the present invention includes three holepunch assemblies, at top, middle and lower positions. Use of three separate assemblies saves material over, for example, U.S. Pat. Nos. 5,553,958 and 5,209,592.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION OF THE PREFERRED EMBODIMENTS

Figure 1:
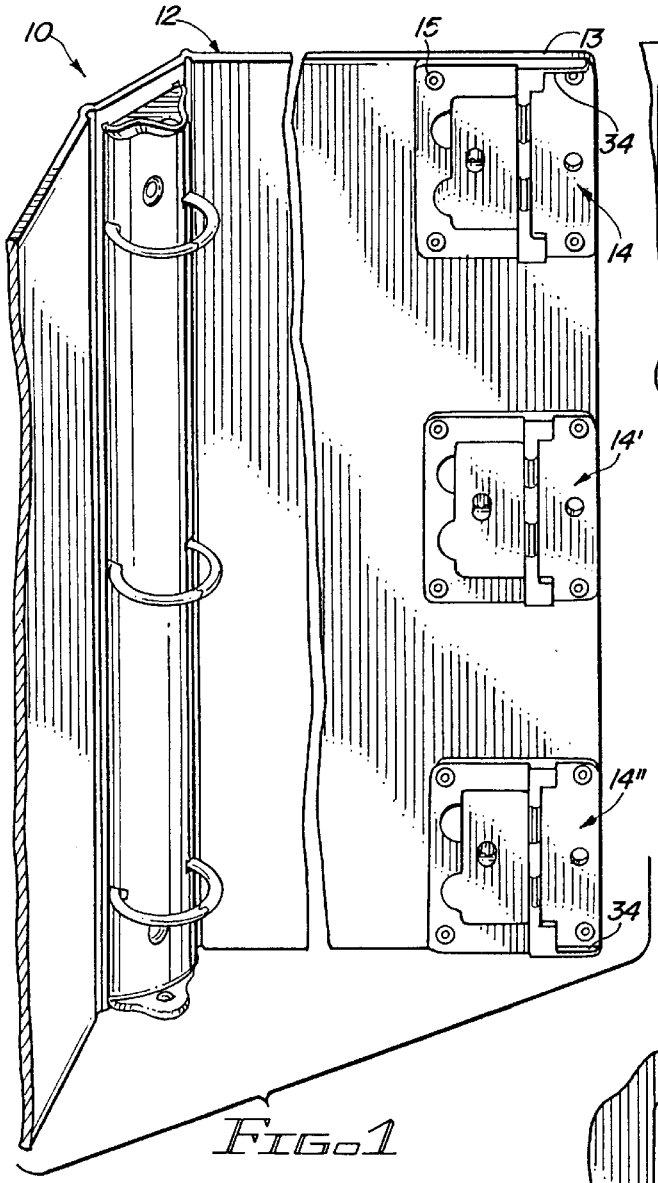
FIG. 1 is a perspective view of the combination book and holepunch assembly of the present invention, all three holepunch assemblies thereon shown in a stowed position.

Referring now to the drawings and the characters of reference marked thereon FIG. 1 illustrates a first embodiment of the combination book and holepunch assembly of the present invention, designated generally as 10. The apparatus 10 includes a book, designated generally as 12, having a flat portion thereon, such as a front or back cover 13. Three holepunch assemblies, each designated generally as 14, 14', 14" are securely attached to the flat portion 13, such as by rivets 15.

Although the principles of the present invention are particularly adaptable to a 3-ring or other ringed notebooks, it is understood that such a usage is shown for the purpose of illustration and not limitation. Other types of books may use the principles described hereinafter.

Figure 6:
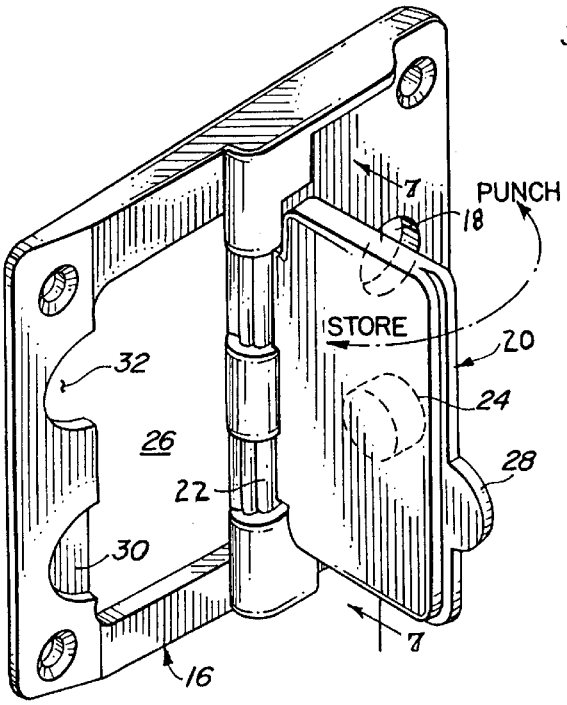
FIG. 6 is a perspective view of the upper holepunch assembly shown detached from the book for the purposes of clarity.

As can perhaps best be seen in FIG. 6, each holepunch assembly 14 includes a first rigid plate 16 (which is securely connected to the book 12) with an opening 18 formed therethrough. A second rigid plate 20 is rotatably connected to the first rigid plate 16 via a hinge 22. The second rigid plate 20 includes a punching element or projection 24. The punching element is sized and spaced to align with the opening 18 when the second plate 20 is rotated away from a stowed position so as to provide a holepunching capability when paper is inserted between the first plate 16 and the second plate 20.

Figure 2:
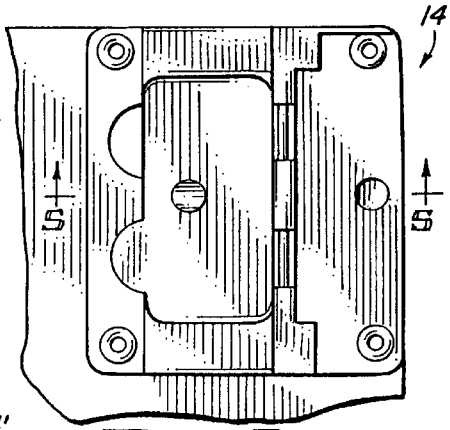
FIG. 2 is a close up view of the upper unit.
Figure 5:
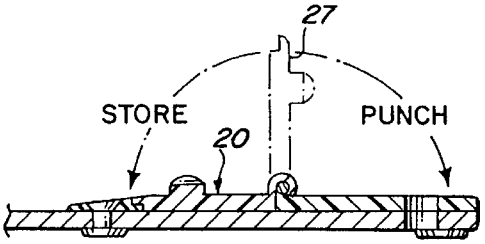
FIG. 5 is a view taken along Line 5—5 of FIG. 2, the second rigid plate being shown rotated in phantom lines.

The first plate 16 includes a second opening 26 for accommodating the second rigid plate 20 while in the stowed position. The top unit 14 is shown in FIGS. 1, 2 and 5. The second opening 26 maximizes the amount of usable volume within the book 12. Phantom lines 27 illustrate the rotation of the second rigid plate 20 from the stowed position to a punch position.

The second rigid plate 20 includes a tab 28 to enhance a user's ability to manipulate the second rigid plate 20. The first rigid plate 16 includes an associated tab receiving opening 30 for stowing the tab 28. The first rigid plate also includes a finger hole 32 to enhance a user's ability to grasp the second rigid plate 20 from the stowed position.

Figure 3:
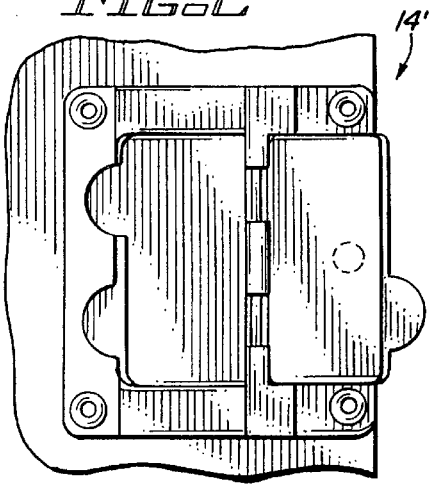
FIG. 3 shows the middle holepunch assembly in a punch mode.
Figure 4:
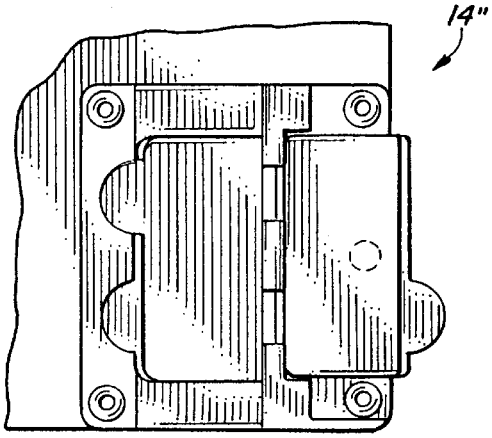
FIG. 4 shows the lower holepunch assembly in a punch mode.

FIGS. 3 and 4 show the middle holepunch assembly 14' and lower holepunch assembly 14" in the punch mode.

The upper holepunch assembly 14 is positioned at an upper edge corner of flat portion 13. The lower holepunch assembly 14" is positioned at a lower edge corner of flat portion 13. Each of these holepunch assemblies has a paper stop 34 formed therein. The middle holepunch assembly 14' is positioned at a central portion of the edge of the flat portion 13. Thus, the capability of punching three holes in a desired spaced relationship is provided.

Figure 7:
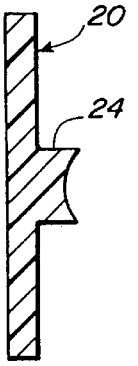
FIG. 7 is an enlarged detail of the punch of the holepunch assembly.

Referring now to FIG. 7, an enlarged view of a projection or punching element 24 is shown. It preferably has a concave upper surface which provides enhanced cutting capabilities.

Figure 8:
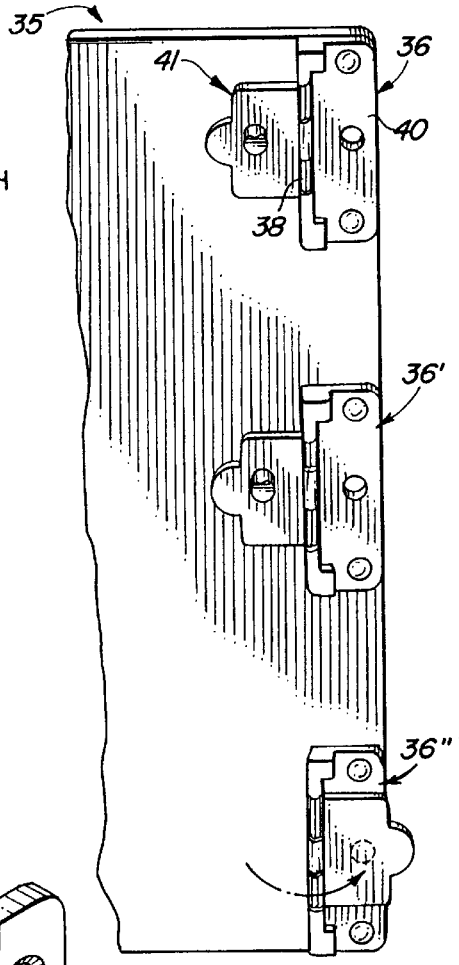
FIG. 8 is a perspective view of a second embodiment of the combination book and holepunch assembly of the present invention.
Figure 9:
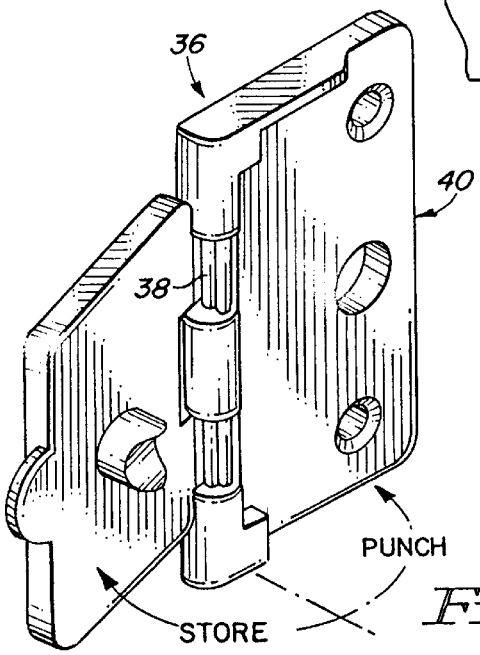
FIG. 9 is a perspective view of a holepunch assembly, of the second embodiment, shown detached from the book for the purposes of clarity.

In the holepunch assemblies shown in FIGS. 1–6, the hinge mechanism is located in a central portion of the first rigid plate 20. FIGS. 8 and 9 show an embodiment designated generally as 35, in which the holepunch assemblies 36, 36', 36" contain hinge mechanisms 38, which are each located at an edge of their respective first rigid plate 40. The holepunch assemblies 36, 36', 36" of this embodiment require less material than the first embodiment. Second rigid plates 41 operate as in the previous embodiment.

Figure 10:
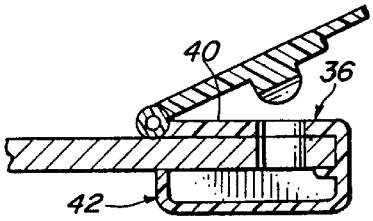
FIG. 10 is a cross-sectional showing use of a scrap receiver tray.

Referring now to FIG. 10, the use of a scrap receiver tray 42 is illustrated. The scrap receiving tray 42 includes a door at the end (not shown) to remove scraps. The tray 42 is removable from the first rigid plate 40. It is attached by a friction fit. Alternatively, for example, the tray might be hingedly connected to the first rigid plate (this embodiment not illustrated).

In another possible design, the scrap tray can be removable while making the first rigid plate 40 slightly narrower and by allowing the separate scrap tray to squeeze (i.e. friction fit) the binder by grasping the inside and outside surface of the binder with a friction fit. In still another possible design (also not shown) the tray is hingedly connected to the edge of a holepunch assembly. In still another alternative, the scrap tray can utilize a scrap door hinged to the scrap tray at the bottom of the unit.

Obviously, many modifications and variations of the present invention are possible in light of the above teachings. It is, therefore, to be understood that within the scope of the appended claims, the invention may be practiced otherwise than as specifically described. For example, although the invention has been described in terms of a separate book unit and holepunch assembly unit, it is contemplated that the book and holepunch assembly may be formed of integral, unitary construction.

What is claimed and desired to be secured by Letters Patent of the United States is:

1. A combination book and holepunch assembly, comprising:

a book having a substantially flat portion thereon; and at least one holepunch assembly securely attached to said flat portion, said at least one holepunch assembly, comprising:

a) a first rigid plate securely connected to said flat portion, said first rigid plate having an opening formed therethrough; and b) a second rigid plate rotatably connected to said first rigid plate, said second rigid plate including a punching element, said punching element being sized and spaced to align with said opening in said first plate when said second plate is rotated away from a first position to a second position so as to provide a holepunching capability when paper is inserted between said first plate and said second plate.

2. The combination book and holepunch assembly of claim 1, wherein said first rigid plate includes a second opening for accommodating said second rigid plate while in said first position thereby maximizing the amount of usable volume within said book.

3. The combination book and holepunch assembly of claim 2, wherein:

said second rigid plate comprises a tab to enhance a user's ability to manipulate said second rigid plate; and said first rigid plate includes a tab receiving opening for stowing said tab.

4. The combination book and holepunch assembly of claim 2, wherein said first rigid plate includes a finger hole to enhance a user's ability to grasp said second rigid plate from said first position.

5. The combination book and holepunch assembly of claim 1, wherein an edge of said first rigid plate is positioned adjacent to an edge of said book.

6. The combination book and holepunch assembly of claim 1, wherein said second rigid plate is rotatably connected to said first rigid plate by a hinge mechanism located in a central portion of said first rigid plate.

7. The combination book and holepunch assembly of claim 1, wherein said second rigid plate is rotatably connected to said first rigid plate by a hinge mechanism located at an edge of said first rigid plate.

8. The combination book and holepunch assembly of claim 1, wherein said at least one holepunch assembly comprises three holepunch assemblies, a first holepunch assembly positioned at an upper edge corner of said flat portion, a second holepunch assembly positioned at a middle edge of said flat portion, and a third holepunch assembly positioned at a lower edge corner of said flat portion thereby providing the capability of punching three holes in a desired spaced relationship.

9. The combination book and holepunch assembly of claim 8, wherein said first and third holepunch assemblies each have paper stops formed therein.

10. The combination book and holepunch assembly of claim 1, further comprising a scrap receiver tray connected to said at least one holepunch assembly.

* * * * *